United States Patent [19]

Mueller

[11] Patent Number: 4,806,235

[45] Date of Patent: Feb. 21, 1989

[54] APPARATUS FOR CLEANING GRAIN PRODUCTS

[75] Inventor: Roman Mueller, Niederuzwil, Switzerland

[73] Assignee: Gebrueder Buehler A.G., Switzerland

[21] Appl. No.: 880,799

[22] Filed: Jul. 1, 1986

Related U.S. Application Data

[63] Continuation of Ser. No. 714,717, Mar. 21, 1985, Pat. No. 4,636,305.

[30] Foreign Application Priority Data

Mar. 22, 1984 [DE] Fed. Rep. of Germany ..... 3410573

[51] Int. Cl.[4] ..... B07B 1/28; B07B 7/06

[52] U.S. Cl. ..... 209/321; 209/139.1; 209/154

[58] Field of Search ..... 209/311, 312, 313, 318, 209/325, 326, 246, 321, 502, 466, 508, 138, 139.1, 144, 154

[56] References Cited

U.S. PATENT DOCUMENTS

| | | | |
|---|---|---|---|
| 2,217,710 | 10/1940 | Shaler | 209/312 X |
| 2,548,142 | 4/1951 | Carter | 209/312 X |
| 2,598,199 | 5/1952 | Vissac | 209/312 X |
| 2,810,481 | 10/1957 | Lofquist et al. | 209/502 |
| 3,380,585 | 4/1968 | Salete | 209/318 |
| 3,464,553 | 9/1969 | Hancock | 209/467 |
| 4,330,400 | 5/1982 | Schmidt | 209/502 |
| 4,466,542 | 8/1984 | Oehker et al. | 209/318 X |

FOREIGN PATENT DOCUMENTS

| | | | |
|---|---|---|---|
| 213076 | 12/1955 | Australia | 209/466 |
| 487706 | 12/1953 | Italy | 209/312 |
| 963578 | 4/1983 | U.S.S.R. | 209/312 |
| 701336 | 12/1953 | United Kingdom | 209/321 |
| 713294 | 8/1954 | United Kingdom | 209/318 |
| 760135 | 10/1956 | United Kingdom | 209/312 |

OTHER PUBLICATIONS

T. Baumeister, Mechanical Engineers Handbook, McGraw Hill, N.Y., pp. 7-59.

*Primary Examiner*—Robert B. Reeves
*Assistant Examiner*—Donald T. Hajec
*Attorney, Agent, or Firm*—Darby & Darby

[57] ABSTRACT

In the case of an apparatus for cleaning grits, which has a plurality of superimposed screen layers, which can be vibrated by means of at least one unbalance exciter and with an inlet or outlet for the product inlet or screen discharge arranged at one end, collecting means with adjustable setting flaps for the screenings, as well as an air circulation through the screen layers over an air distribution chamber in a suction collecting channel adjustable by means of adjusting flaps, it is provided that the apparatus is constructed as a stand with a stand head, a stand base and a vertical intermediate support connecting said two parts, the screen layers being constructed as a dust box and being vibratably supported in the vicinity of the stand base, the stand top being formed by the upper air distribution chamber.

6 Claims, 6 Drawing Sheets

APPARATUS FOR CLEANING GRAIN PRODUCTS

This is a continuation of application Ser. No. 714,717, now U.S. Pat. No. 4,636,305.

BACKGROUND OF THE INVENTION

The present invention relates to an apparatus for cleaning grits of the type having a plurality of superimposed screen layers, means for vibrating the screen layers, an air circulation through the screen layers, and collecting means for providing the screen discharge at an outlet of the apparatus.

Apparatus of the aforementioned type for cleaning grits, constitute special machines which are almost exclusively used in flour milling. They make it possible to sort, from the product supplied to the machine, grits and dust and individual corn grits.

The main function is the sorting of the grits fractions with a maximum granulation range and consisting of clean grits, mixed products, light products, special products (cooking grits, etc.), seed, etc. The maximum yield of clean grits is sought.

Fluctuations in the incoming capacity of the product must not have a negative influence on the working quality. The machine setting must not be unintentionally changed during the working process.

On the basis of the principles of industrial processing engineering, it would be conceivable to obtain the components through a number of different separation systems. The main criteria are the heaviness of the fractions, the sinking speed of the fractions in the air flow and the size of the fractions.

Other branches of industrial processing engineering use for such tasks, e.g. fluidized beds with pulsating air, centrifugal sifters, tare means, air classifiers and other equipment. However, it has been found that such equipment cannot be used for improving the grits cleaning machine. The specific demands made in connection with the obtaining of grits can clearly only be met with the known grits cleaning machines known since the beginning of the 18th century. It has been once again found that, as in many other long known technical solutions, such as the bicycle, it is extremely difficult to find important new ideas and convert them into practice.

The known grits cleaning machines have in the meantime been constructionally and functionally developed (and have also required certain framework conditions) in such a way that the Experts could not have expected further significant improvements, particularly with regards to overall design.

The problem of the present invention is to develop a grits cleaning machine, which compared with known machines of this type, in particular permits a further improvement in the production rate, facilitates the cleaning thereof, has lower power requirements and allows particularly inexpensive manufacture, without reducing the quality and yield of the end products.

According to the invention this problem is surprisingly solved in connection with an apparatus for cleaning grits of the aforementioned type, in that the apparatus is constructed as a stand with a stand top, a stand base and a vertical intermediate support interconnecting said top and base, the screen layers being constructed as dust boxes, whilst being supported in vibratable manner in the vicinity of the stand base, the stand top being formed by the upper air distribution chamber. The novel solution firstly provides free space for the central operating functions, whilst auxiliary functions are concentrated at non-disturbing points. The solution according to the invention makes it particularly simple to keep the apparatus clean, as well as the area around the apparatus. Initial tests revealed that this solution as a whole leads to advantages, without any disadvantages being apparent. In addition, the invention makes it possible to realize a number of unexpected improvements in connection with the further particularly advantages developments, which will be referred to hereinafter.

Preferably in the case of a grits cleaning machine according to the invention, constructed in the form of a double machine, the stand is provided with an intermediate support at either end. The dust box can be supported in vibratable manner by means of a spring system, e.g. on a base structure of the stand. As the actual core of the machine, the dust box is preferably supported in the vicinity of the stand base and the space above it is utilized for the optimum construction of the upper air distribution chamber. The invention permits a clean circulation of the product, as well as an optimum distribution of the air. Through supporting the vibration mass at the bottom, preferably at the stand base, the vibration forces are directly led off. The stand can be designed for its main function of carrying the various components. Due to the fact that both the cleaning of the grits and the necessary mechanical forces are concentrated on their actual working zone, not only can the work quality be maintained and the productive efficiency increased, but also the life of the complete apparatus can be increased. The vibration forces can be kept completely away from the air circulating components, so that once the air circulation has been set or the flaps are correspondingly positioned, there can be no further undesired self-adjustment.

A resilient component is preferably positioned between the stand and the dust box, so that the reaction forces on the apparatus, which result from the vibration forces, can "peter out" in the actual apparatus, because the stand and the stand top represent an effective counterweight with respect to the vibrating components. According to another preferred embodiment, the elastic member can be positioned between the stand base and the intermediate support of the stand. According to another preferred development of the invention, the elastic members are arranged between the intermediate support of the stand and the stand top. Preferably, the intermediate supports themselves are constructed as elastic components, so that an unexpectedly quiet stable operation of the apparatus is obtained.

According to a further preferred embodiment of the apparatus according to the invention, the intermediate supports project over the dust box at the top and at the bottom pass symmetrically and at both ends into in each case a stand base, the space between the two stand bases being free from immovably fitted components. Thus, over and beyond the length of the complete apparatus, there is lateral space for air circulation, also on the inside thereof.

An unexpectedly favourable influence both on the air circulation and on the separation of the end products can be obained in that below the dust box for the air intake is formed a lower air distribution chamber by means of a base which is supported at the bottom in vibrating manner and preferably between the base and the dust box air intake gaps of roughly a few centimetres are formed.

It has hitherto been assumed in the case of apparatuses operating in suction manner, that the air intake zone below the fluidized bed was not particularly problematical, local problems in the incident flow having no significant influence on the air distribution. Only as a result of the present invention was it recognized that hitherto a definite source of problems had been overlooked in the lower air distribution chamber, because in the known constructions, said chamber was simultaneously also used for the purpose of distributing the individual end product fractions. As it was assumed that the individual fractions would in any case drop downwards as screenings, no further attention was paid to this point prior to the present invention. The solution according to the invention provides a clearly defined lower air distribution chamber and the supply of the individual fractions can take place below said chamber, whilst being separated by the base. Generally two to four different fractions are obtained from the screenings, the granulation varying in the longitudinal direction. In order to ensure a maximum clear separation into the individual fractions, according to a further advantageous embodiment of the invention, the base is constructed as an inwardly sloping conveyor chute having a plurality of product guide flaps in its central lower portion.

If two collecting devices constructed as double conveyor chutes are arranged below the base and which in each case have two different outlets in the longitudinal direction, advantageously a particularly sharp separation into the desired fractions can be obtained in that the bottom has individual trough-shaped depressions corresponding to the number of product guide flaps and the lower opening of said depressions can be emptied, as required, to either of the collecting devices by means of the product guide flaps. The product guide flaps as chutes tiltable about a pivot point in each case are preferably constructed in such a way that the cross-section of the outlet between the chutes and the base is smaller than the cross-section of the air intake gaps. As the air flow seeks the path of least resistance, a corresponding air flow is ensured by the indicated solution, so that the product removal area remains free from any disturbing air flow. As stated, it is possible to arrange directly above the stand base, a double conveyor chute vibrating in the same direction as the dust box and which is supported on the stand base, whereby preferably a vibrating movement is selected for the same, which differs from the vibrating movement of the dust box.

Another advantageous development of the invention comprises, viewed in the air flow direction, the adjusting flaps being positioned behind the air distribution chamber. According to another advantageous development of the invention, over the screen layers, the air distribution chamber has a conically tapering shape with a plurality of bulkhead-like air circulating chambers, which extend close to the uppermost screen layer, an ajusting clap being arranged in each case in a transition piece between the upper end of the tapered shape of the air circulating chambers and the suction channel. The transition piece preferably runs between the upper end of the tapered shape of the air circulating chamber and the suction collection channel, in a substantially horizontal manner. Preferably the said channel is mounted as a separate component on the air distribution chamber and has a cyclone-like construction.

Appropriately, the dust box and the base are constructed, according to an advantageous development of the invention, as a vibrating standard unit and that the two ends is supported at the bottom in vibrating manner, preferably on the stand base. It is also advantageous if the dust box and double vibrating conveyor chute are driven by a common unbalance exciter, the dust box preferably being fixed to the latter and its force action direction is adjustable. Advantageously for increasing the vibrating travel, the double vibrating conveyor chute can be driven by means of a lever joint by the vibratable unit, in that by means of an end support the collecting means is oscillated from the dust box by an actuating lever and a support. The articulation points of the lever on the end support, as well as on the collecting means support being variable for adjusting the range.

According to a particularly advantageous development of the invention, the dust box is supported by means of a spring system, so that the complete vibrating structure is given two additional "degrees of freedom" for the vibrating movement. The spring system preferably has hollow rubber springs, steel springs or a flexible rubber coupling. This makes it possible to fix the vibration exciter to the dust box, whilst still making the force action direction adjustable. As a function of the force action direction with respect to the centre of gravity of the vibrating unit, it is possible to adjust the vibration at the beginning and end of the dustbox in both direction and intensity, as required. When supporting the collecting means via a vibratable lever system, which is preferably vibratable by an adjustable actuating lever from the dustbox, the vibration amplitude can be chosen independently of the vibrating movement of the dust box, although this takes place with the same unbalance exciter.

BRIEF DESCRIPTION OF THE DRAWINGS

The invention is described in greater detail hereinafter relative to non-limitative embodiments and the attached drawings, wherein show.

DETAILED DESCRIPTION OF THE PREFERRED EMBODIMENTS

Figure 1:
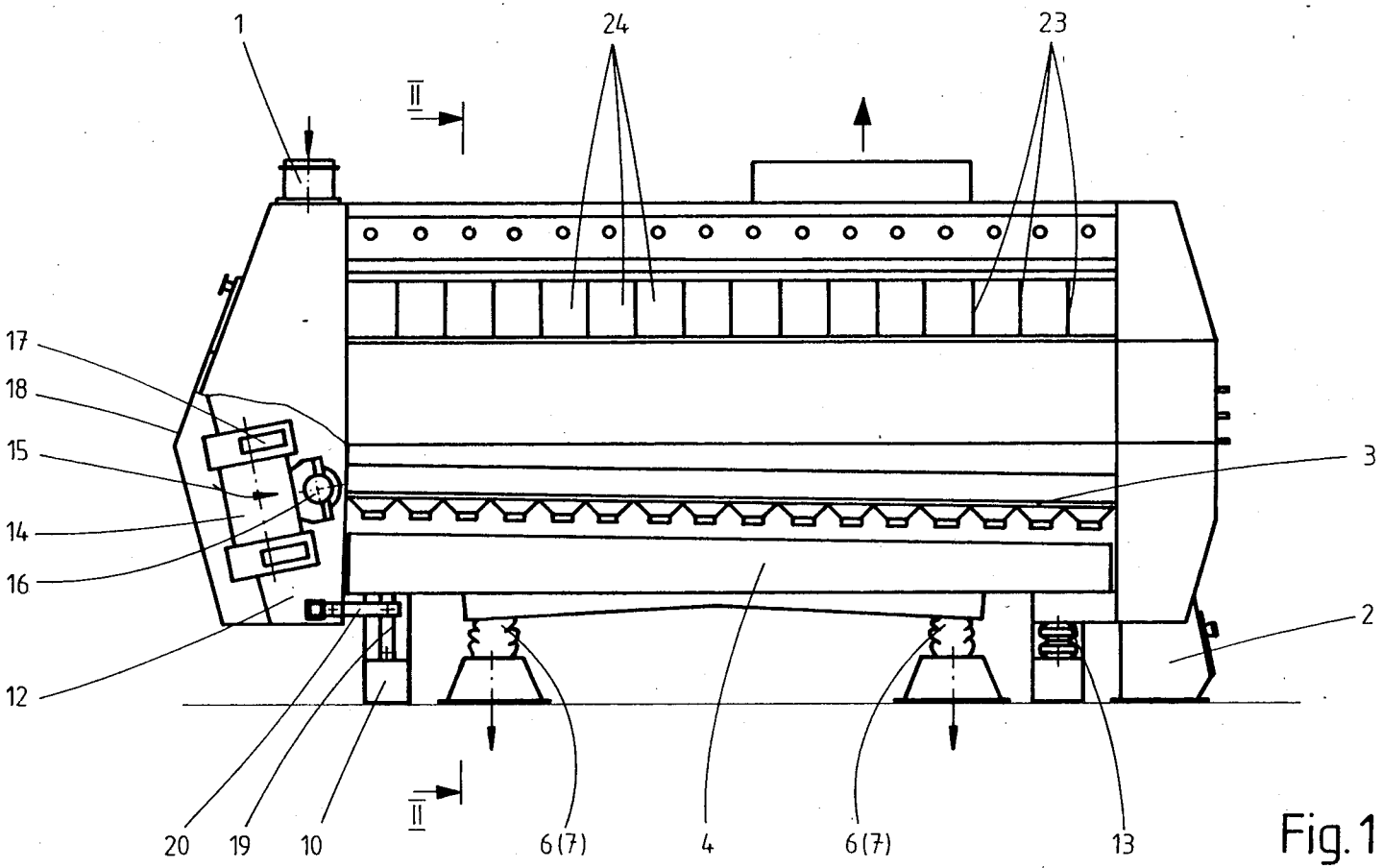
FIG. 1 a longitudinal view of an apparatus according to the invention.
Figure 2:
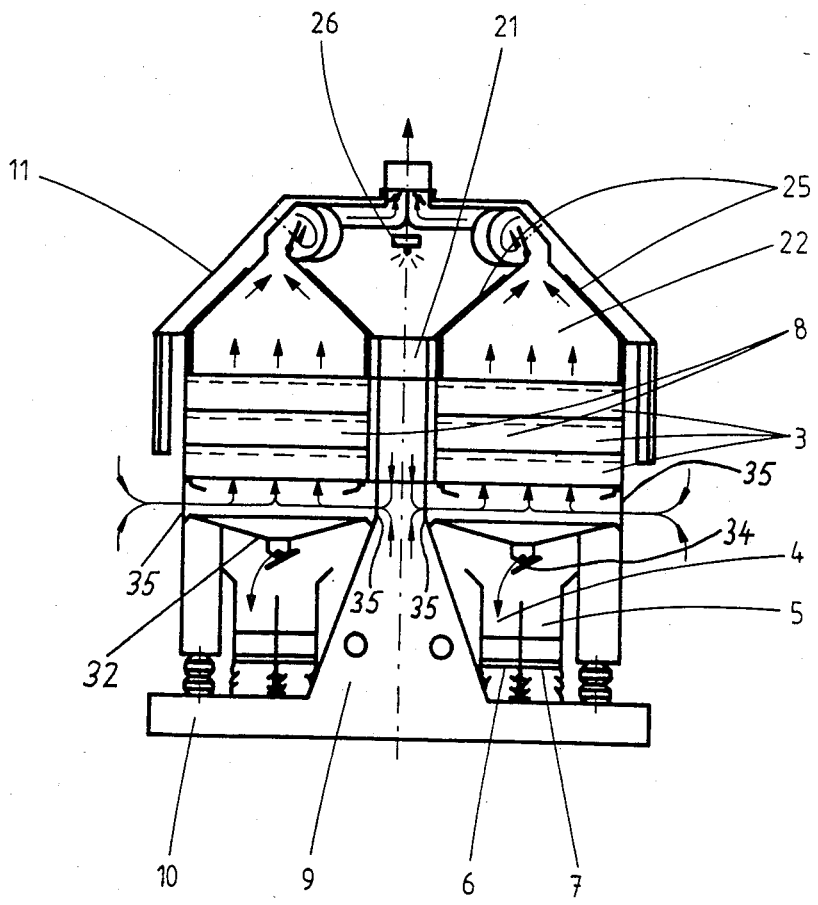
FIG. 2 a section II—II from FIG. 1.

Reference is firstly made to FIGS. 1 and 2, which, like the other drawings, show a so-called double machine, which comprises two completely separate grits cleaning machines as is apparent from FIG. 2. These two machines are separately arranged to the left and right with respect to the central stand construction.

At the top left in FIG. 1 it is possible to see an inlet 1 for the product to be supplied to the apparatus and to the bottom right outlets 2 for the screen discharge. Three superimposed screen layers are designated by the reference numeral 3. Below screen layers 3 is provided an inner collecting means 4, as well as an outer collecting means 5 (FIG. 2), which collect the screenings and in general each individual collecting means 4 or 5 has two outlets 6, 7. The screen layers 3 are in each case combined to form a dust box 8 (FIG. 2), so that in accordance with the represented embodiment, it is possible to choose with respect to each dust box 8 two outlets 2 for the screen discharge as well as four outlets 6, 7 for the screenings. Dust box 8 is supported in vibrating manner by means of an end support 12 (FIG. 1) via vibrating members or hollow rubber springs 13 on a stand base 10 of a stand 9. An unbalance exciter 14 is fixed to end support 12, the impact direction (cf. arrow 15 in FIG. 1) being adjustable by revolving the unbalance exciter 14 on a tubular cross connection 16. In addition, and as known, the strength of the unbalance forces can be regulated by corresponding setting of unbalance weights 17. Two unbalance exciters 14 are fixed to cross connections 16 and are so electrically connected that they rotate in opposite directions to one another. This cancels out their lateral unbalance moment and leads to a purely linear longitudinal vibration in the direction of arrow 15. A cover 18 is placed over the unbalance exciters 14 and for constructional simplification purposes is constructed as part of the vibrating system.

The collecting means 4 is constructed as a vibrating conveyor chute, which rests at both ends on in each case a rubber-mounted support 19 (FIG. 1). The vibrating drive of the collecting means 4 takes place by means of a lever 20, which connects the vibrating end support 12 to support 19. As a function of the height position (which is variable), at which lever 20 acts on support 19, it is possible to select or adjust the vibrating travel of collecting means 4 independently of the vibrating travel of dust box 8. Stand 9 directly carries all the non-vibrating components, the vibrating components being mounted by means of the lower part of the stand. At either end of stand 9 is provided in each case a vertical support 21 (FIG. 2), which at the bottom pass via an extension into the base structure. According to FIG. 2, the vertical support 21 extends slightly beyond the uppermost screen layer and carries the stand top or top member 11, which essentially forms the upper air distribution chamber 22. The latter has an upwardly tapering shape, as a result of the two laterally outermost of the windows 25 being inclined towards each other to form inclined top walls for the air distribution chamber, and is subdivided over its length into 16 separate air circulating chambers 34 by means of bulkheads 33. As can be gathered from FIG. 5, bulkheads 23 extend close to the top screen layer, the spacing being selected in such a way that it is always somewhat larger than the greatest possible material layer thickness S.

Figure 5:
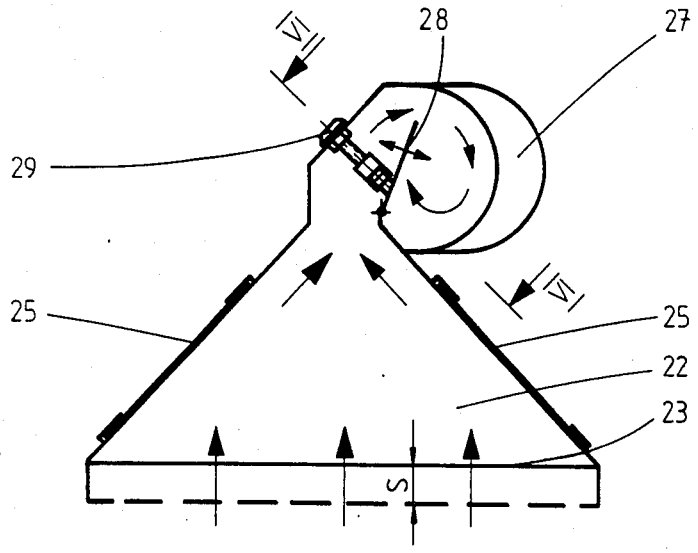
FIG. 5 a diagrammatic view of the upper air distribution chamber in an apparatus according to the invention.
Figure 6:
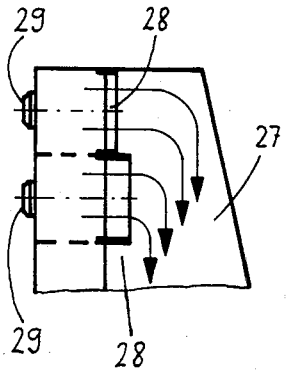
FIG. 6 a sectional view along line IV—IV in FIG. 5.

The upper sloping surfaces of the air distribution chamber 32 have transparent windows 25 (FIG. 2) over the entire length thereof, so that it is possible from the outside of the apparatus by using an electric light source 26 to control the material flow behaviour over the top screen layer 3. Between the upper end of the air distribution chamber 22 and a suction collecting channel 27, FIGS. 5 and 6 show adjusting flaps 28, which, by means of a knob 29, can be adjusted in accordance with the particular air requirements.

Figure 3:
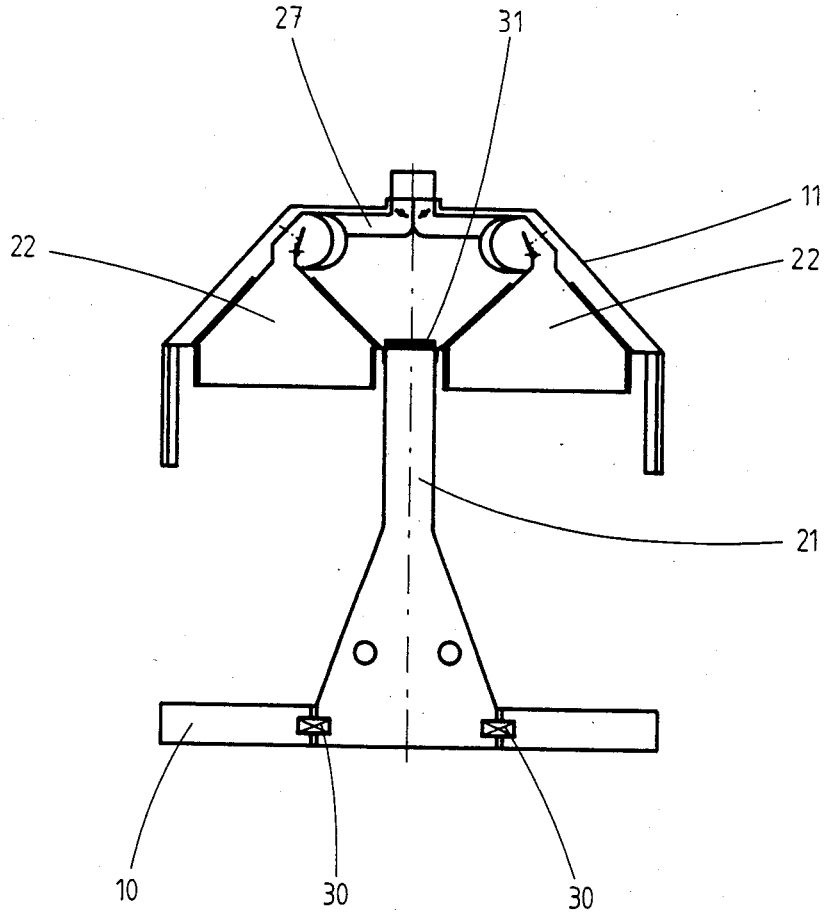
FIG. 3 a diagrammatic view of an apparatus according to the invention with a stand and a stand top.
Figure 4:
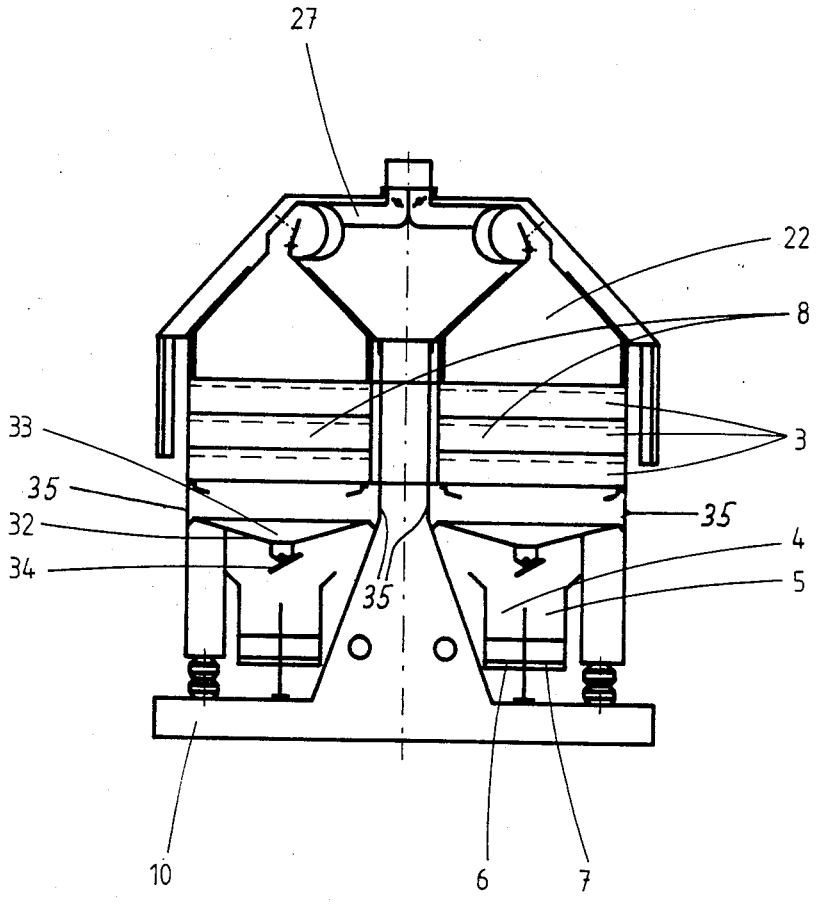
FIG. 4 the representation of FIG. 3, supplemented by the vibrating components.

FIG. 3 shows the basic construction of the non-vibrating components of the apparatus (stand construction), the same drawing showing two embodiments. One of the possible embodiments comprises interposing an elastic or resilient component 30 between the stand base 10 and the vertical support 21. According to the second embodiment, an elastic or resilient member 31 is positioned between the stand base 10 and the stand top 11. In the first case, stand base 21, together with stand top 11 forms a vibration damping mass for the non-vibrating parts. In the second case, the vibration damping mass is formed by the stand top 11 alone. According to an additional embodiment, the stand base 21 could be produced in lightweight construction form, and embody the resilient member. Another particularly advantageous embodiment can be seen in FIGS. 2 and 4. Between dust box 8 and the outlet 6, 7 is provided a vibratable base 32 supported on stand base 10. Over the entire length of base 32 is provided a plurality of depressions 33 which, at the bottom, are oriented by means of product length flap or chute 34 (FIG. 4) towards the inner or outer collecting means 4 or 5. Preferably the number of chutes 34 is roughly the same as the corresponding number of air circulating chambers 34. It can be seen that the working air flows via air suction gaps or air intake openings 35 provided on either side immediately below the vertical wall portion of stand top 11. These measures lead to a number of advantages. Firstly the air flow guidance takes place completely separately from the product removal, which occurs below base 32 where there is no air flow. Moreover, the laterally inflowing air ensures that the product stream dropping on to base 32 is deflected in the direction of the centre of the base where chute 34 is located and is consequently "concentrated" towards the inside. Another advantage is that the product flow is guided by chute 34 on to the innermost of the vibrating collecting means 4 or 5, and is removed by means of outlets 6, or 7. In addition, the product flow has a certain self-cleaning effect. According to the prior art, the adjusting flaps are directly fitted to the collecting means 4 or 5. As a result one half of the collecting means 4, 5 is permanently covered, so that cut off dirt traps could form below it. Another important advantage is that the screenings are very accurately separated into the desired fractions, because disturbing longitudinal air flows are eliminated.

On putting the present grits cleaning machine into operation, vibrator 14 is switched on, so that dust box 8, base 32 and collecting means 4 and 5 perform the preselected vibrating movement in the longitudinal direction of the apparatus. In the same way, the complete apparatus is placed under a slight vaccum by means of the suction collecting channel 27 or a suction means connected thereto. All the slides and flaps are provisionally set in accordance with the separating function. Product can then be fed into intake 1 and immediately drops on to the top screen layer 3. As a result of the shaking movement of the materials, the screen layers which deliberately slope downwards from inlet 1 to outlet 2 as well as the air flow through the screen layers, the product acts in the same way as a fluid (fluidized). The basic function of the grits cleaning machine is constituted by the actual screening process. Thus, the air flow must not be so strong, that the complete product layer could be raised from the screen layers. In fact the main function of the air is to loosen the product and distribute it uniformly over the entire surface.

In accordance with the set problem, the product is to be subdivided into coarse, medium and fine grits or into cooking grits and medium grits, etc. In the second case e.g. the first six chutes can be directed into collecting means 4 and the following eleven chutes into collecting means 5. In this case, the two screenings are finished products, which can be supplied to the corresponding storage locations or to consumers. The screen discharges at outlets 2 are partly returned for further milling or crushing and then reach a second, correspondingly set grits cleaning machine. In the latter, the specific screen mesh sizes required for the particular function are selected, but this does not form part of the present invention.

Once the grits cleaning machine is in full operation, the function of the miller starts, namely evaluating the operation of the apparatus, as well as the quantitative and qualitative evaluation of the fractions obtained.

For this purpose, lamp 26 (FIG. 2) is switched on, so that the entire space within the air distribution chamber is illuminated. The flow behaviour of the product over the entire length within the individual air circulating chambers 24 can be observed through windows 25. If within one or more of the air circulating chambers 24 a picture similar to that of boiling water is obtained, the quantity of air in the particular chambers 24 is restricted by means of adjusting flaps 28. Conversely, there can be an accumulation at individual points, so that accordingly a local air quantity must be increased. If the product flow behaviour is completely satisfactory and the mixed product (outlets) contains no fractions belonging to the screenings, then the quality of the screenings is again checked and the allocation of the chutes 34 to the in each case correct collecting means 4, 5 is set.

As can be gathered from FIG. 1, two different outlets 6, 7 can be selected in each collecting means 4, 5, so that four different fractions can be separated from each dust box 8.

Figure 8:
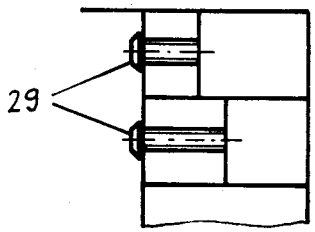
FIG. 8 a detail plan view of the representation of FIG. 7.
Figure 7:
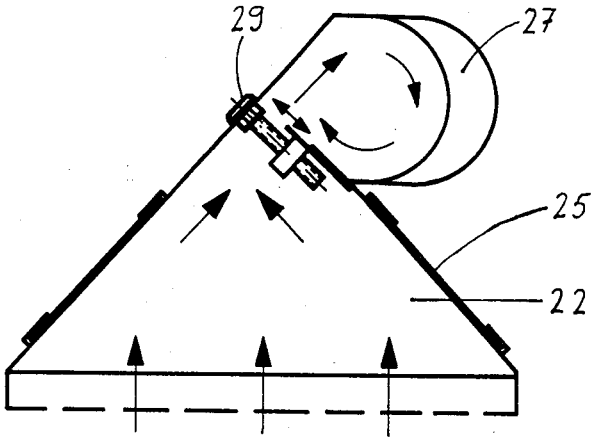
FIG. 7 another embodiment with respect to FIG. 5.

FIGS. 7 and 8 show an advantageous embodiment as an alternative to the solution from FIGS. 5 and 6. Instead of the adjusting flaps 28 used therein, slides are used in the solution according to FIGS. 7 and 8. These slides permit a more accurate setting of the air requirement in all slide positions. In accordance with the revolutions of top 29, a proportional cross-sectional modification of the slide opening is brought about. In the case of a flap, no similar proportional cross-sectional change would occur, because in this case the effective opening cross-section would not change proportionally to the revolution of the top. The use of slides offers the further advantage, that the free cross-section of the suction collecting channel 27 is not influenced by the different opening positions of the slides.

Particularly in the case of the solution according to FIGS. 7 and 8, it has been found that the suction collecting channel 27 can have a constant cross-section in the air flow direction.

Figure 9:
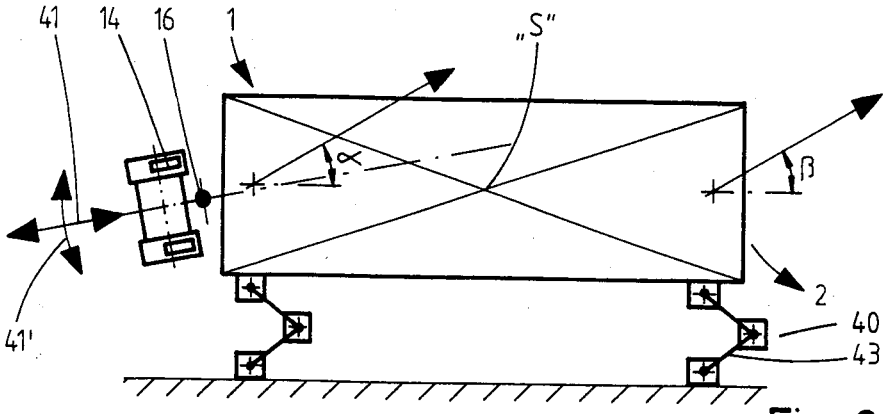
FIG. 9 the supporting of the dust box by means of a flexible rubber coupling in diagrammatic form.

FIG. 9 shows the support of the vibrating unit of a rubber coupling 42, which is embodied by a spring system 40.

As can be gathered from FIG. 1, the unbalance exciter 14 can be rotated about a transversely directed axis 16, so that the force action direction 41 can be adjusted, as required and as indicated by arrow 41'. If the force action direction passes through the centre of gravity S of the vibrating unit, generally a uniform vibration of the complete stack of screens is obtained. However, if the force action direction 41 does not pass through the centre of gravity S, then, as a function of the particular requirements, it is possible to set in the vicinity of inlet 1 a vibration corresponding to the angle $\alpha$ and at outlet 2 a vibration corresponding to the angle $\beta$.

Figure 10:
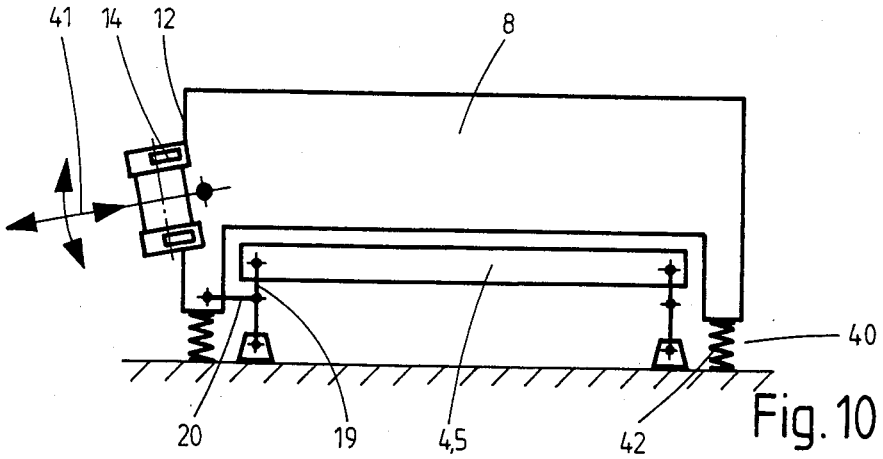
FIG. 10 the combined supporting of the dust box on springs and the vibrating conveyor chute on a lever joint (diagrammatically).
Figure 11:
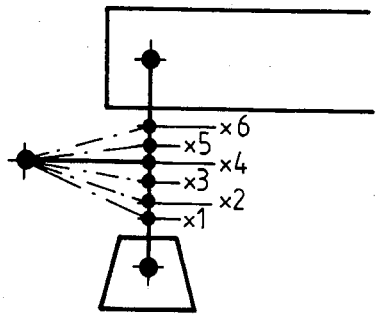
FIG. 11 a diagrammatic view of the varying force transfer possibilities from the dust box to the vibrating conveyor chute.

FIGS. 10 and 11 show a further particularly advantageous embodiment. In this case, the dust box 8 is mounted in vibrating manner as a free vibrator on a spring system 40 or a steel spring 42. The unbalance vibrator adjustable with respect to the force action direction is fixed to end support 12 and, through the use of two vibrators 14 vibrating in opposite direction, leads to a substantially purely linear vibrating movement according to FIGS. 9 or 1. Collecting means 4, 5 are mounted in vibrating manner on a support 19, independently of dust box 8. End support 12 is connected to support 19 by means of a lever 20, so that the vibrations of the unit vibratably supported by means of lever system 40 can be transferred via lever 20 to collecting means 4, 5. Lever 20 can be fixed to support 19 at different height positions X1, X2, . . . X6. This gives the possibility to initiate or force varyingly large, lateral vibration amplitudes of the collecting means 4, 5, on the basis of the drive of unbalance exciter 14 and via a correspondingly selected lever path. This leads to a surpsingly simple vibration structure. For the actual "screening" function, the stack of screens performs a short vibration, whilst, corresponding to the function of a vibrating conveyor chute, collecting means performs a long vibratingprojectile movement, which is aided by the correct articulation of lever 20 on supports 19. The operating result of this combined free vibrator—lever vibrator has proved to be surprisingly good.

What is claimed is:

1. In an screening apparatus for separating grain products, the apparatus being of the type utilizing a generally upwardly flowing air stream to assist in the separation of grain particles of different sizes, the air flow being achieved through the action of at least one air distribution chamber extending along the length of the apparatus at the top thereof said air distribution chamber being in communication with a source of suction, the improvement comprising:

at least one of said at least one air distribution chamber having an upwardly tapering shape when viewed in lateral cross-section;

a plurality of laterally oriented bulkhead walls spaced along the length of said apparatus to divide said at least one air distribution chamber into a plurality of upwardly tapering air circulating chambers;

suction channel means extending along said at least one air distribution chamber exteriorly thereof and connected to each air circulating chamber for communicating suction thereto from said source of suction, said suction channel means being constructed to operate as a cyclone; and means for controlling air flow disposed exteriorly of said air distribution chambers and interposed between each of said air circulating chambers and said suction channel means, said means for controlling cooperating with said suction channel means to achieve a circumferential air flow therein, whereby said cyclone operation occurs.

2. An apparatus in accordance with claim 1 wherein at least one of said air circulating chambers has an opening near its top, and said means for controlling air flow comprises a flap which is pivotally mounted so as to be exterior of said air circulating chamber and to close said opening, but to pivot away from said air circulating chamber into said suction channel means to selectively uncover said opening.

3. An apparatus in accordance with claim 1 wherein at least one of said air circulating chambers has an opening near its top, said means for controlling air flow comprising a wall slidably mounted to selectively close off and uncover said opening.

4. An apparatus in accordance with claim 1 wherein said at least one air distribution chamber comprises a plurality of air distribution chambers extending along the length of the appratus in side-by-side arrangement, said apparatus having a top member with first and second inclined walls oriented to impart an upwardly tapering shape to said top member when viewed in lateral cross-section, said first inclined wall defining a portion of the top of one of said air distribution chambers, and the second inclined wall defining a portion of the top of a second of one of said air distribution chambers, and a depending wall at the laterally outermost edge of each of said inclined walls, at least one of said depending walls defining an air intake gap at its lowermost end.

5. An apparatus in accordance with claim 4 wherein at least one of said air circulating chambers has an opening near its top, and said means for controlling air flow comprises a flap which is pivotally mounted so as to be exterior of said air circulating chamber and to close said opening, but to pivot away from said air circulating chamber to selectively uncover said opening.

6. An apparatus in accordance with claim 4 wherein at least one of said air circulating chambers has an opening near its top, said means for controlling air flow comprising a wall slidably mounted to selectively close off and uncover said opening.

* * * * *